United States Patent [19]

Rogers

[11] 4,319,747

[45] Mar. 16, 1982

[54] CONVERTIBLE EXERCISE BENCH AND ACCESSORY APPARATUS

[76] Inventor: J. Frank Rogers, North Augusta Plz., North Augusta, S.C. 29841

[21] Appl. No.: 70,264

[22] Filed: Aug. 27, 1979

[51] Int. Cl.[3] ..... A63B 21/06

[52] U.S. Cl. ..... 272/73; 272/93; 272/117; 272/123; 272/134; 272/144

[58] Field of Search ..... 272/117, 93, 123, 73, 272/144, 134, 109, 122, 67, DIG. 2, 118, 145

[56] References Cited

U.S. PATENT DOCUMENTS

| | | | |
|---|---|---|---|
| 3,625,511 | 12/1971 | Rennemann | 272/144 |
| 3,640,527 | 2/1972 | Proctor | 272/134 |
| 3,708,166 | 1/1973 | Annas | 273/118 |
| 4,153,244 | 5/1979 | Tauber, Jr. | 273/123 |
| 4,188,029 | 2/1980 | Brower et al. | 273/145 |

*Primary Examiner*—Richard C. Pinkham
*Assistant Examiner*—T. Brown
*Attorney, Agent, or Firm*—Bailey, Dority & Flint

[57] ABSTRACT

Multi-purpose body exercising apparatus is disclosed of the type which includes a convertible exercise bench which easily and readily converts to perform a number of different exercises thereon by means of simplified accessory attachment means fixed to the exercise bench frame which facilitates fast interchange of a variety of accessory exercise apparatus in a manner suitable and economically affordable for home use.

9 Claims, 9 Drawing Figures

CONVERTIBLE EXERCISE BENCH AND ACCESSORY APPARATUS

BACKGROUND OF THE INVENTION

This invention relates to exercising apparatus and more particularly to improved multi-purpose or combination bench exercising apparatus wherein a variety of exercises can be performed on a single exercise bench.

Heretofore, multi-purpose bench exercise devices have been provided such as disclosed in U.S. Pat. Nos. 4,098,502 and 3,625,511 which include single bench exercise devices which allow for different exercises to be performed on the device without the need for additional exercise machinery or tools. Other attempts to provide multi-purpose exercising devices have required that many individual exercise devices be utilized with the exercise bench and the attachment of the exercising devices has often required tools and has been so complicated as to make impossible the interchange of the devices during a limited time in which one desires to engage in an exercise program.

It is an important object of the present invention to provide multi-purpose body exercising apparatus which offers a wide range of different exercises and is operationally and economically suitable for in-home use.

Another important object of the present invention is to provide multi-purpose exercise apparatus having a basic exercise bench frame which may be rapidly and simply converted to a number of different exercise events by means of simplified and uniform accessory attachment means and uniquely designed accessory exercise equipment whereby a wide range of exercises may be entered into in a shortened time duration.

Yet another important object of the present invention is the provision of multi-purpose exercise apparatus which includes a convertible exercise bench frame having means for attaching a wide range of accessory exercise equipment in a manner which affords a structural connection of high integrity.

Another important object of the present invention is the provision of multi-purpose exercise apparatus which includes a convertible exercise bench having a number of different accessory exercise devices which may be uniformly attached in an integral manner assuring a safely balanced exercise bench for each different exercise event.

SUMMARY OF THE INVENTION

It has been found, according to the invention, that a convertible exercise bench which may be rapidly and simply converted between a number of different exercise events may be had by providing accessory attachment means in the form of tubular insert members carried adjacent opposing ends of the bench frame and horizontal tubular insert members spaced at various locations on the frame and by utilizing a number of uniquely designed accessory exercise devices which uniformly attach and interface with the various attachment means such that an exercise program consisting of many different exercise events may be entered into in a relatively short period of time which, particularly, is affordable and suitable for home use.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Figure 1:
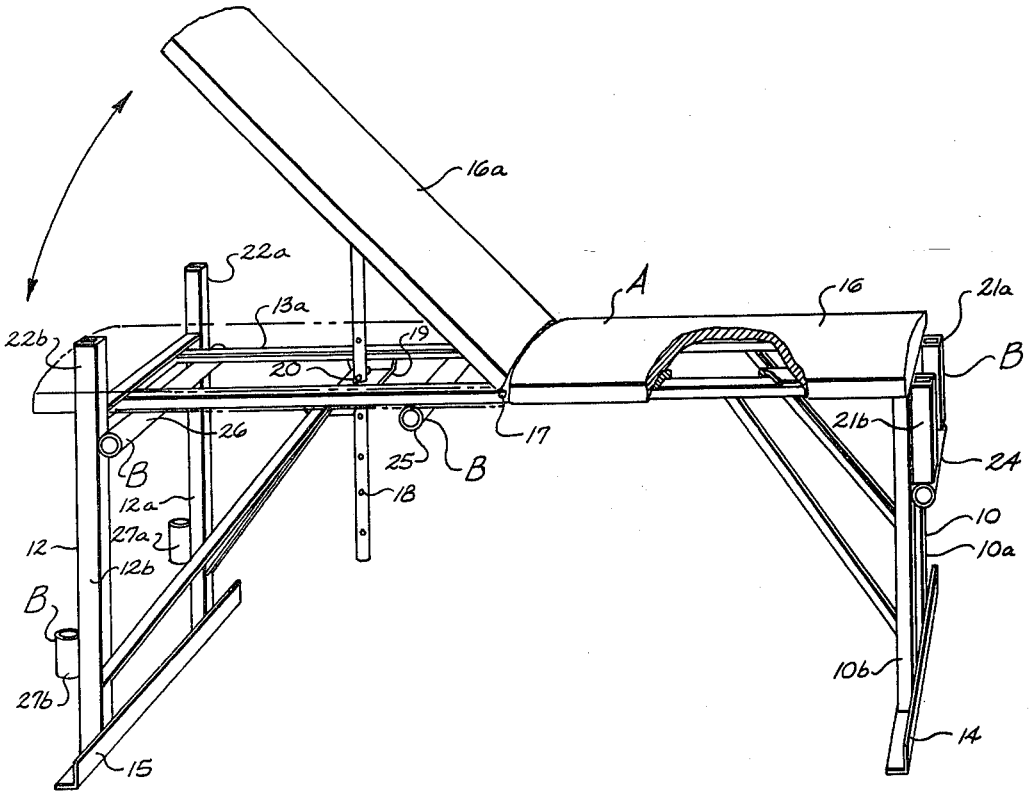
FIG. 1 is a perspective view illustrating a convertible exercise bench and accessory attachment means constructed according to the invention.

The drawings illustrate multi-purpose body exercising apparatus which includes a convertible longitudinal exercise bench A having a body supporting bench pad, and a ground engaging frame supporting the bench pad generally above the ground which includes first and second spaced opposed frame ends. Exercise accessory attachment means B is carried by the exercise bench facilitating the rapid interchange of a variety of accessory exercise apparatus and includes tubular attachment means carried adjacent the frame ends. A number of accessory exercise apparatus C is adapted for uniformly interchangeable and interlocking connection to the exercise bench frame by means of accessory attachment means B. In a particularly novel arrangement, accessory exercise apparatus C includes a pair of laterally spaced pivots and support means carrying the pivots adapted for connection to attachment means B whereby the pivots are carried in an elevated manner above the bench pad. A rotatable crank arm is carried by each pivot engagable by a portion of the body and weight support means connected to each crank arm is adapted for supporting a variety of exercise weights in a manner that rotation of the crank arms causes the weights to be raised and lowered.

Referring to the drawings in detail, the convertible exercise bench A is illustrated as including a first frame end 10 which includes a pair of vertical legs 10*a* and 10*b* and a second frame end 12 which includes vertical legs 12*a* and 12*b*. Longitudinal frame members 13*a* and 13*b* connect the vertical legs and may be made integral therewith in any suitable manner such as by welding. In a like manner, base feet 14 and 15 may be provided and welded to the respective frame legs for engaging the ground, supporting the bench in a rigid manner. A body supporting bench pad 16 is provided in the form of a two-piece section wherein one piece 16*a* is pivotable about a pivot 17 and may be adjusted in its inclination by means of adjusting bar 18, a support bracket 19, and pin 20 received in holes formed in the adjusting bar. The bench pad 16, of course, being padded for comfortably supporting the body of one exercising.

Accessory attachment means B includes a first pair of tubular sleeve members 21*a* and 21*b* carried adjacent the first end 10 of the bench frame and tubular sleeve members 22*a* and 22*b* which are provided by hollow vertical legs 12*a* and 12*b*. The accessory attachment means further includes horizontal tubular sleeves 24 carried across frame legs 10*a* and 10*b*, horizontal tubular member 25 carried across longitudinal frame members 13*a* and 13*b*, and horizontal tubular member 26 carried across frame legs 12*a* and 12*b*. Auxiliary vertical tubular members 27*a* and 27*b* are also provided for the purpose as will further be described herein. All of the various tubular sleeve members affixed to the bench frame may be fastened thereto in any suitable manner as by welding. Tubular members 24 and 26 provide horizontal attachment means for attaching weights which provide counter-balance for certain exercises. The tubular sleeve members so described, provide simplified yet highly reliable structural connection between the bench frame and various accessory exercise apparatus as will be hereinafter described.

Figure 2:
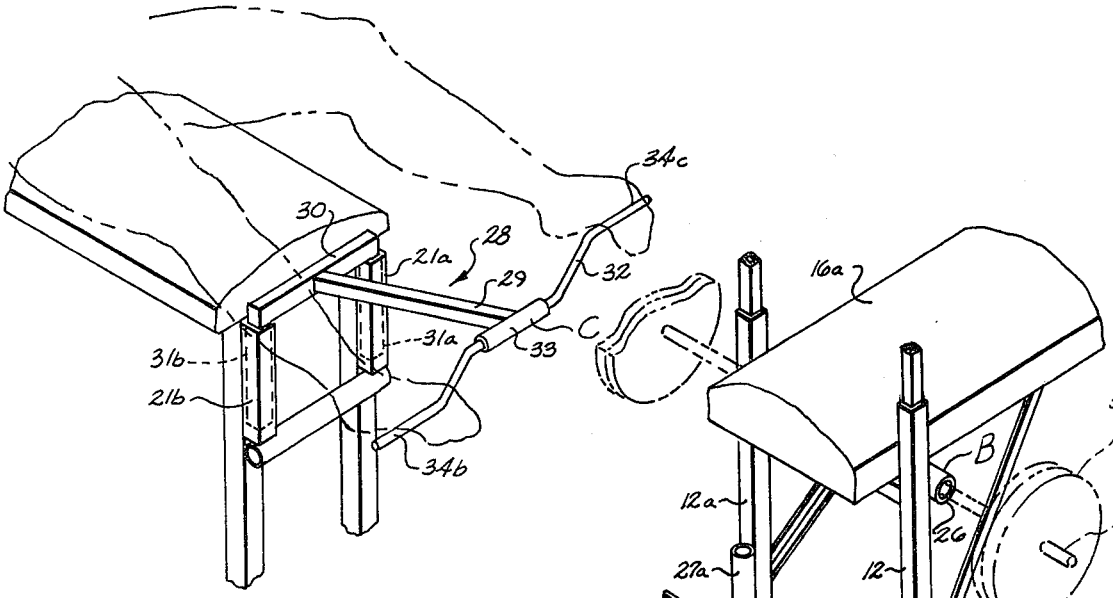
FIG. 2 is a perspective view illustrating an exercise bench partially cut away having accessory attachment means and accessory bicycle exercising apparatus constructed according to the invention.

Referring now to FIG. 2, accessory exercise apparatus C is illustrated in the form of a bicycle exercise device, designated generally as 28, which includes an outwardly extending bar 29. Connecting means for connecting the bar 29 to the accessory attachment means 21*a* and 21*b* includes a transverse supporting bar 30 and integral depending leg inserts 31*a* and 31*b* which are received and interlocked within the tubular members 21*a* and 21*b*. Adjacent the remote end of the bar 29 is a crank means 32 rotatably connected to the bar by means of a bearing block 33 wherein the crank 32 includes offset pedal members 34*a* and 34*b* adapted for being engaged with the extremeties of the body for exercise by rotation of the crank member.

Figure 3:
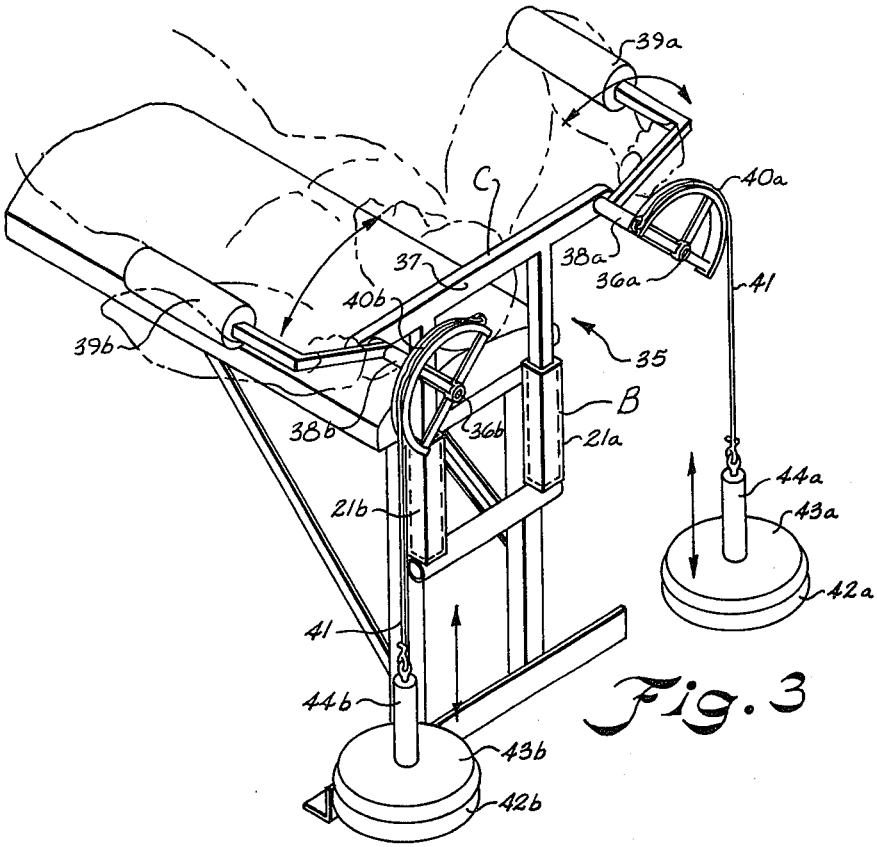
FIG. 3 is a perspective view illustrating an exercise bench partially cut away having accessory attachment means and accessory butterfly exercise apparatus constructed according to the invention.

Referring now to FIG. 3, the details of the butterfly device, generally referred to as 35, will be described. The device includes generally horizontal pivots 36*a* and 36*b* which are laterally spaced by means of a support 37. The pivots may be connected to the accessory attachment means by insertion of vertical insert legs 37*a* and 37*b* into the tubular members 21*a* and 21*b*, respectively. Rotatable crank arms 38*a* and 38*b* carried about respective pivots 36*a* and 36*b*. The pivots may be integral with the support bar 37 and the crank arms may rotate freely on the pivots. The crank arms further include cushion portions 39*a* and 39*b* engageable by the arms of the exerciser. Weight support means connected to each crank arm and adapted for supporting a variety of exercise weights is provided by arcuate members 40*a* and 40*b* connected by means of cable members 41 to weight supports 42*a* and 42*b*. The arcuate members are integral with the ends of crank arms 40 and can be made as one piece or welded. The weight supports accommodate placement of variable size exercise weights 43*a* and 43*b* and include connecting spindles 44*a* and 44*b* which are connected to the cable in such a manner that as the crank arms rotate the cables follow the arcuate members in a manner that the weights are raised and lowered.

Figure 4:
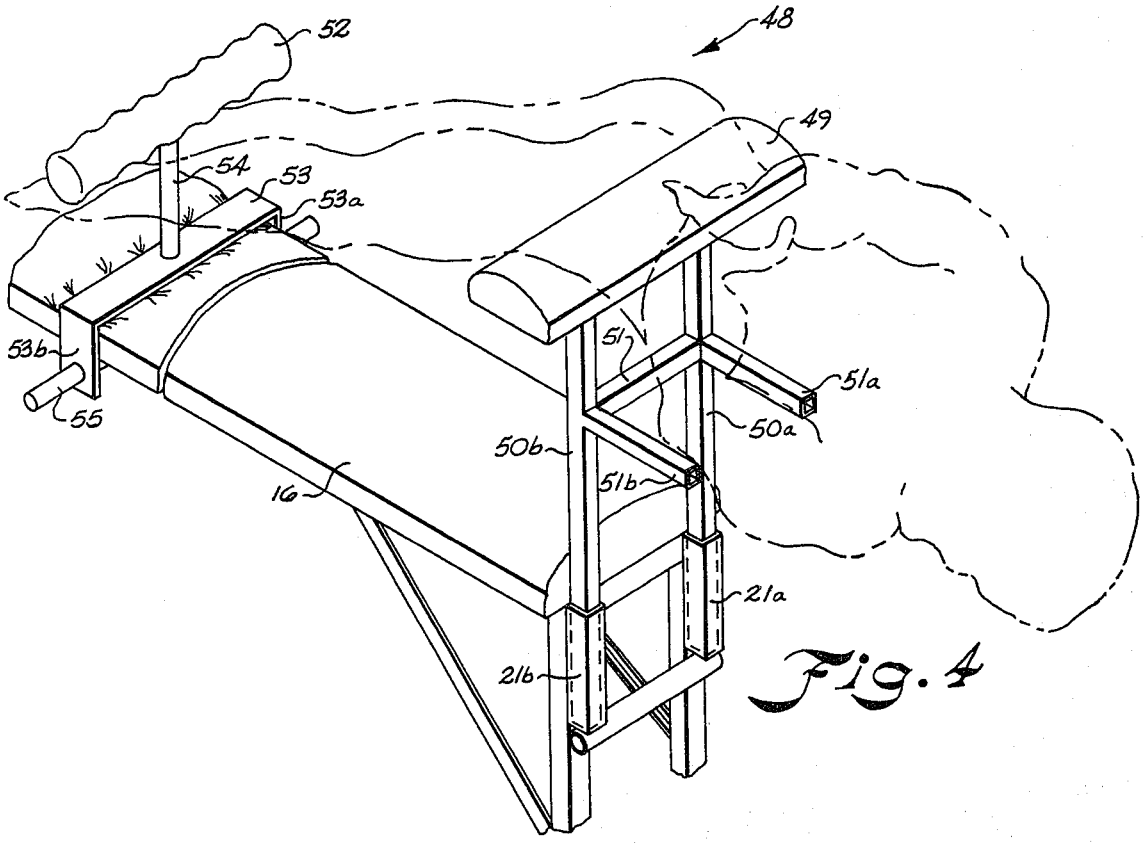
FIG. 4 is a perspective view illustrating an exercise bench having accessory attachment means and Roman chain exercise apparatus constructed according to the invention.

Accessory exercise apparatus C illustrated in FIG. 4 includes a Roman chair device, designated generally as 48, which includes an upstanding body support 49 for supporting a first portion of a body and means for connecting the body support 49 to the accessory attachment means in an elevated position relative to the bench pad 16. The connecting means includes spaced vertical legs 50*a* and 50*b* receivable for interlocking engagement in tubular members 21*a* and 21*b*. Cross member 51 integral with legs 50*a* and 50*b* affords structural integrity and outwardly extending members 51*a* and 51*b* affords some support for the person while getting off and on the chair device. Body engaging means 52 is carried by the exercise bench in an elevated manner above bench pad 16 and means connecting the body engaging means 52 to an attachment means B at a second point, provided by tubular member 25, includes a U-shaped bracket 53 connected to body engaging member 52 by means of vertical rod 54. A rod 55 attaches the bracket to the exercise bench when inserted through tubular member 25 and holes formed in downwardly depending legs 53*a* and 53*b* of the mounting bracket. The body engaging means may be provided in the form of a cushioned roll and is spaced longitudinally from the upstanding body support 49 for engaging a second portion of the body while the body is generally positioned above the bench pad at spaced lengthwise positions for exercise such as during situps or for body exercise in the reverse position as shown in FIG. 4.

Figure 9:
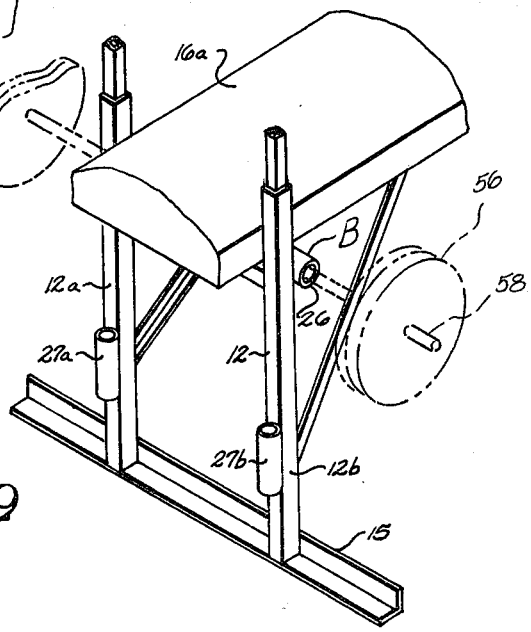
FIG. 9 is a perspective view illustrating exercise bench apparatus having counter-balance weights attached thereto according to the present invention for balancing the bench when converted to certain exercises.

Counter-balancing weights 56 are carried on a standard weight bar 58 slidably received in the hollow of horizontal tubular attachment member 26 serving to balance and stabilize the bench when converted for certain exercises (FIG. 9), such as the Roman chair exercise. The same may be attached to horizontal tube 24 when required to stabilize the bench when exercises are undertaken at bench end 12.

Figure 5:
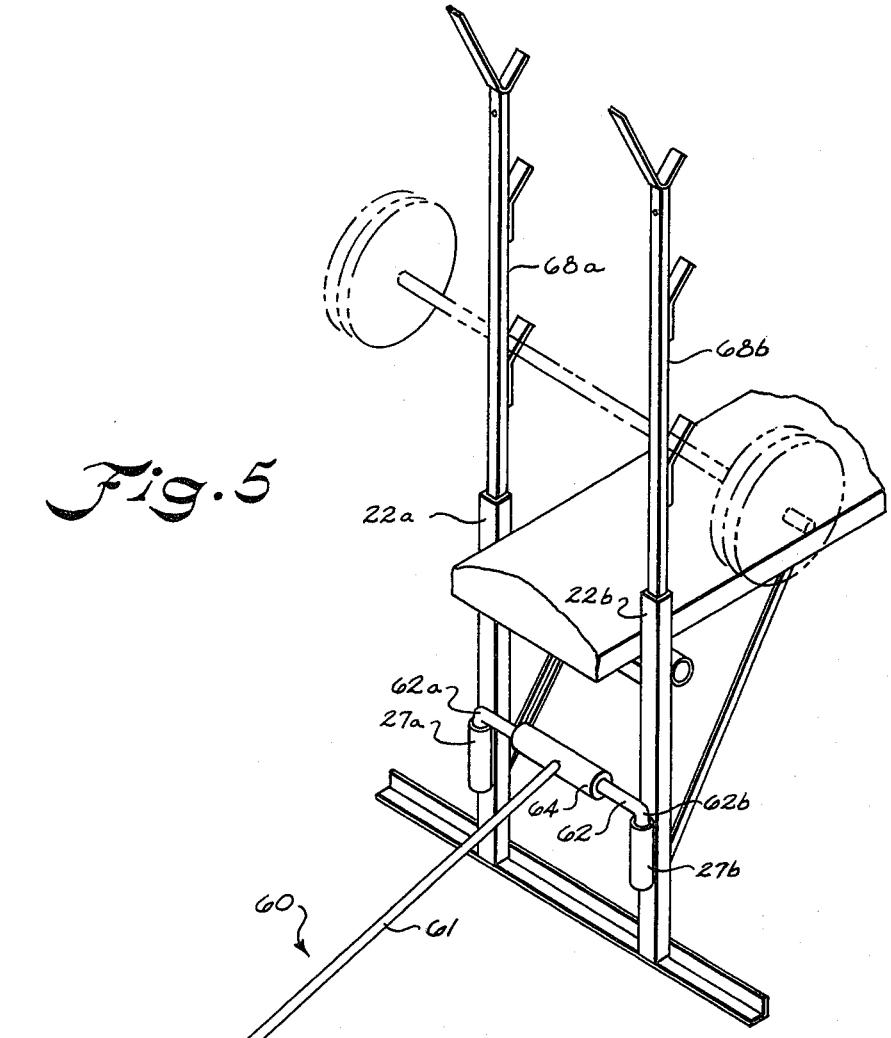
FIG. 5 is a perspective view illustrating an exercise bench partially cut away having attachment means and accessory lat bar exercise apparatus according to the invention.

FIG. 5 illustrates accessory exercise apparatus C in the form of a lat bar device designated generally as 60. The device includes an elongated bar 61 and connection means for connecting the bar to the accessory attachment means allowing the bar to be rotated in a vertical plane. The connection means includes a U-shaped mounting bracket rod 62 and cylindrical bearing block 64 which is integral with the bar 51. The depending legs 62*a* and 62*b* of the mounting rod bracket are received in tubular members 27*a* and 27*b*. The cylindrical bearing block 64, of course, allows rotation about the horizontal member of the mounting bracket rod. Weight support means 65 provided at the remote end of the elongated bar 61 includes integral collar 65*a* and a slidable locking collar 66 which may be removed so that exercise weights may be slid over the end of the bar 61 and locked in place. A body engagement means is provided in the form of a rod 67 between connection means 62 and weight support means 65 for engagement with the hands of the exerciser when in a bent position whereupon the lat bar 61 is raised to the chest of the exerciser and then lowered to the floor as the bar pivots about the horizontal pivot 62.

Figure 6:
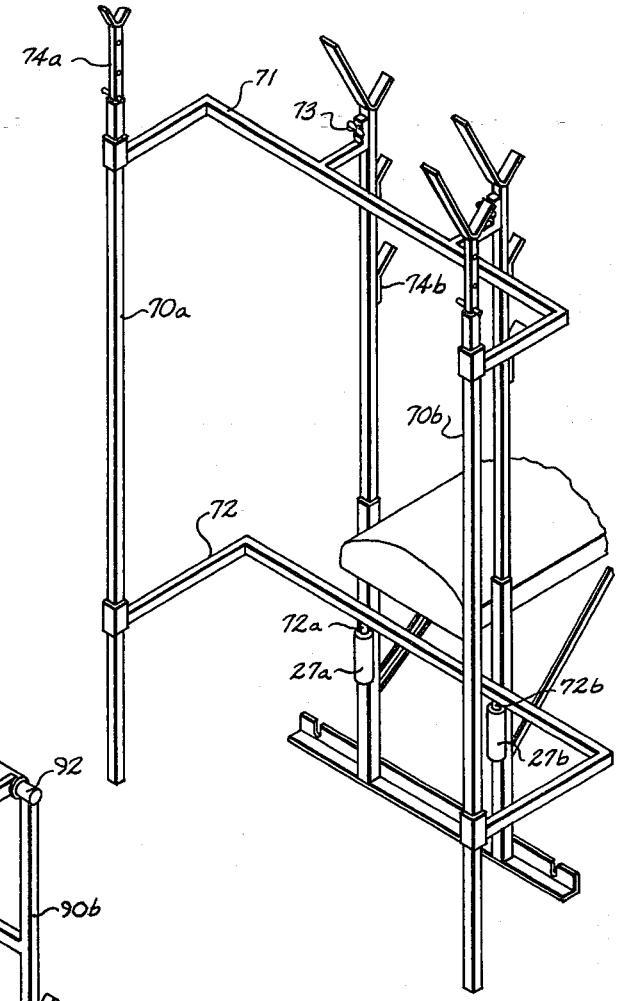
FIG. 6 is a perspective view illustrating an exercise bench partially cut away having attachment means and accessory squat exercise apparatus according to the invention.

A pair of vertical standards 68*a* and 68*b* provide a weight rack when inserted in tubular attachment membes 22*a* and 22*b*, respectively. A squat bar rack may be advantageously connected with the exercise bench as illustrated in FIG. 6 by securing a pair of spaced standards 70*a* and 70*b* to the weight rack legs 68*a* and 68*b* using suitable connecting frame means. The connecting frame includes upper and lower U-shaped frame arms 71 and 72 made integral with the standards 70*a* and 70*b* such as by welding. Upper frame 71 may be attached to the weight rack legs 68*a* and 68*b* by means of any suitable fastening means such as wingnuts 73 inserted through holes therein. Lower U-shaped frame 72 is secured to the attachment means B by means of insert legs 72*a* and 72*b* inserted in the tubular attachment members 27*a* and 27*b*. Adjustable weight supporting members 74*a* and 74*b* may then be utilized to support the weights for squatting exercises as desired.

In this manner, both ends of the exercise bench may be converted to different exercise devices. That is, the lat bar device 60 or the squat rack may be utilized by attachment to the accessory attachment means B at the second end of the bench frame while the other accessory exercise devices heretofore described may be attached to the first frame end.

Figure 7:
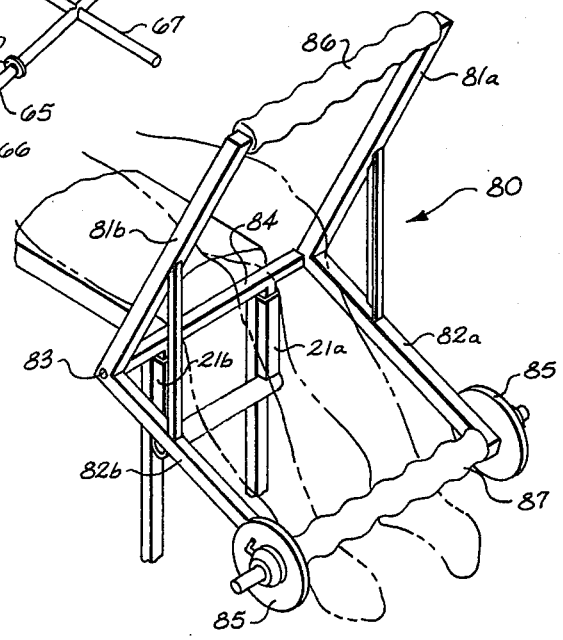
FIG. 7 is a perspective view illustrating an exercise bench partially cut away having attachment means and accessory leg exercise apparatus according to the invention.

FIG. 7 illustrates a leg exercise device wherein a pair of spaced frame legs 81*a* and 81*b* are carried at an angle, preferably ninety degrees to a second pair of spaced frame legs 82*a* and 82*b* which pivot about a pivot 83 carried by connecting support member 84 on which is carried a pair of depending legs 84*a* and 84*b* which insert in the tubular attachment members 21*a* and 21*b*. Adjacent the free ends of legs 82*a* and 82*b* is a weight support member 85 which accommodates the placement of a variety of exercise weights. Transverse bars 86 and 87 extend between legs 81 and 82 for engagement with the body, in particular cushioned bar 87 is engaged by the feet for exercising the legs as illustrated.

Figure 8:
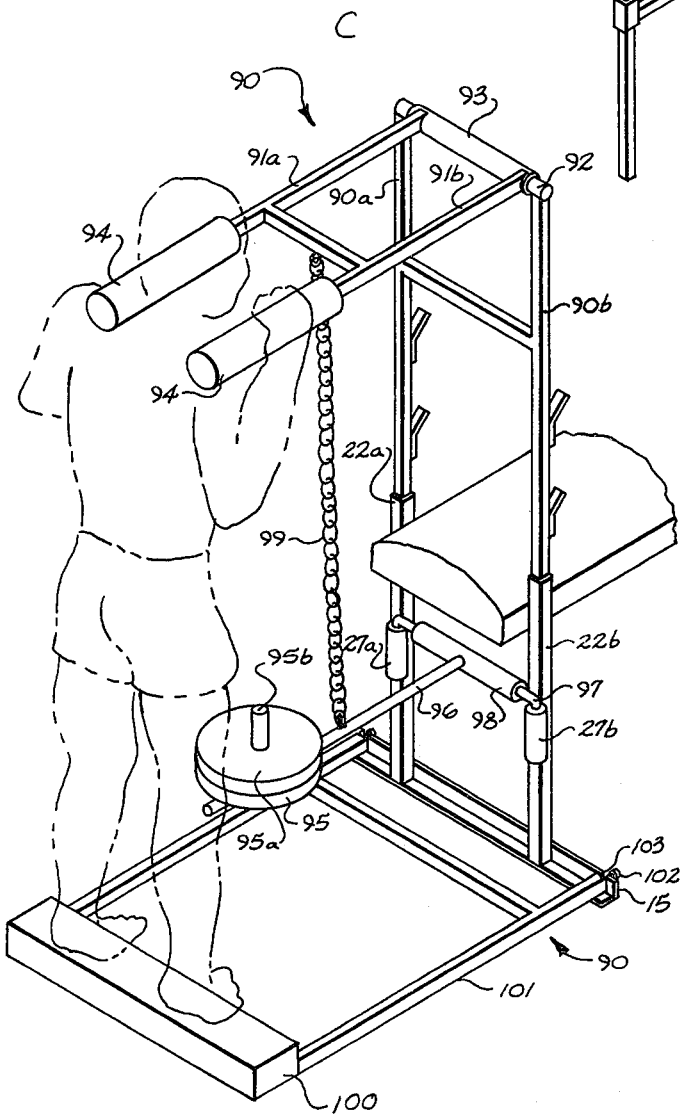
FIG. 8 is a perspective view illustrating an exercise bench partially cut away having attachment means and accessory calf exercise apparatus constructed according to the invention.

Further accessory exercise apparatus C as illustrated in FIG. 8 includes a calf exercise device, designated as 90, which includes a pair of upstanding supports 90*a* and 90*b* which are adapted for connection to the accessory attachment means B by inserting the free ends thereof into the tubular members 22*a* and 22*b*, respectively. A pair of spaced cantilevered arms 91*a* and 91*b* are pivotably connected to the upstanding supports 90*a* and 90*b* by means of a pivot rod 92 and a cylindrical bearing block 93 integral with the cantilevered arms. The free ends of the cantilevered arms may be provided with cushioned material at 94 for engaging against ones body for calf exercise. A lower pivotable weight support means 95 is provided for accommodating a variety of exercise weights and is connected to accessory attachment means B below the cantilevered arms. Means for connecting the weight support means 95 to the exercise bench is provided by a T-shaped mounting bracket including bar 96, U-shaped mounting bracket rod 97, and bearing 98 all of which support the weight support 95 whereby the bearing 98 rotates on the rod 97.

The cantilevered arms are connected to the support means 95 by means of a chain 99 or cable such that movement of the cantilevered arms by engagement with the body causes the weight to be raised and lowered. A calf platform 100 may be provided on which the exerciser stands and may be connected to the bench frame by means of a frame 101 which is connected to the base foot 15 of the frame by means of interlocking screws 102 which are received in slots 103.

Thus, it can be seen that a highly advantageous construction can be had for multi-purpose exercise apparatus according to the invention wherein a convertible exercise bench may be readily converted to a number of different exercise devices in a fast and reliable manner and wherein accessory exercise apparatus attached is done so in a uniform manner without tools in a manner that a balanced exercise bench results.

The integral construction heretofore described may be made in any suitable manner, preferably by welding except where otherwise specified.

While a preferred embodiment of the invention has been described using specific terms, such description is for illustrative purposes only, and it is to be understood that changes and variations may be made without departing from the spirit or scope of the following claims.

What is claimed is:

1. Multi-purpose body exercising apparatus comprising:

a. longitudinal convertible exercise bench having a body supporting bench pad;

a ground engaging bench frame supporting said bench pad generally above the ground which includes first and second spaced opposed frame ends;

exercise accessory attachment means carried by said exercise bench facilitating the rapid exchange of a variety of accessory exercise apparatus;

accessory exercise apparatus adapted for interchangeable connection to said exercise bench and bench frame by means of said accessory attachment means;

said accessory attachment means including spaced vertical tubular attachment means carried by said bench frame adjacent at least one of said ends;

said accessory exercise apparatus including a number of individual exercise devices for performing different body exercises;

horizontal tubular attachment means carried by said bench frame generally at or below the level of said bench pad, said horizontal tubular attachment means being hollow for receiving a weight bar therethrough for counter-balancing said exercise bench during attachment and operation of certain ones of said individual exercise devices;

each said exercise device including corresponding tubular connection means facilitating interlocking engagement with said tubular attachment means; and said connection means and attachment means being uniform for each said exercise device providing rapid and simplified connection between each said exercise device and said bench frame;

whereby said exercise bench may be readily converted to provide a number of different exercise events.

2. The apparatus of claim 1 wherein said accessory attachment means includes intermediate attachment means carried by said bench frame for connecting accessory exercise apparatus intermediate said first and second ends and wherein said accessory exercise apparatus includes:

an upstanding body support for supporting a first portion of ones body;

connecting means adapted for connecting said upstanding body support to said accessory attachment means in an elevated position relative to the exercise bench supporting surface;

body engaging means for engaging a portion of said body;

connection means for connecting said body engaging means to said intermediate attachment means in an elevated position above said exercise bench pad; and said body engaging means being spaced longitudinally from said upstanding body support for engaging a second portion of said body whereby the body is generally positioned above said exercise bench at spaced lengthwise portions for example.

3. The apparatus of claim 1 wherein said accessory exercise apparatus includes:

a pair of laterally spaced pivots;

support means upon which said pivots are carried adapted for connection to said accessory attachment means;

an arcuate member carried by each said pivot;

weight supporting means attached to said arcuate member for accommodating a variety of exercise weights and cable means connected to said arcuate member and depending downwardly having a free end connected to said weight supporting means whereby rotation of said arcuate members effects the raising and lowering of said weights;

crank means connected to each said arcuate member for rotating said arcuate members; and said crank means including body engaging arm portions whereby said crank means is engaged and turned about said pivots when engaged by a portion of the body for exercise.

4. The apparatus of claim 1 wherein said accessory exercise apparatus includes:

a pair of upstanding supports having first ends adapted for connection to said accessory attachment means;

a pair of spaced cantilevered arms pivotally connected adjacent the remote ends of said upstanding supports;

a lower pivotable weight supporting means connected to said accessory attachment means spaced below said cantilevered arms and adapted for supporting a variety of exercise weights;

means connecting said cantilevered arms and said lower pivotable weight supporting means whereby movement of said cantilevered arms causes said weights to be raised and lowered for exercising the body of a person bearing against said cantilevered supports.

5. The apparatus of claim 1 wherein said accessory exercise apparatus includes;

an outwardly extending arm;

connection means for connecting said outwardly extending arm to said accessory attachment means; and crank means rotatably connected to free end of said outwardly extending arm including offset pedal members adapted for being engaged with the extremeties of the body for exercise by rotation of said crank member.

6. The apparatus of claim 1 wherein said accessory exercise apparatus includes:

an elongated bar;

connection means for connecting said elongated bar to said accessory attachment means allowing said bar to rotate in a vertical plane;

weight supporting means carried adjacent a free end of said bar adapted for supporting a variety of exercise weights; and body engagement means carried by said bar intermediate said connection means and weight supporting means for engagement by a portion of the body for exercise.

7. The apparatus of claim 6 wherein said accessory exercise apparatus further includes a second pair of spaced arms extending outwardly from said opposing ends of said first spaced arms; and a transverse body engaging member carried between the free ends of said second spaced arms for engaging a portion of ones body and causing said weight means carried adjacent the free ends of said first spaced pair of arms to be raised and lowered for exercise.

8. The apparatus of claim 1 wherein said accessory exercise apparatus includes:

a pair of spaced arms;

weight support means carried adjacent free ends of said arms for accommodating placement of a variety of exercise weights;

connecting means carried adjacent opposing ends of said spaced arms adapted for connection to said accessory attachment means in an outwardly extending manner from said exercise bench when attached thereto; and said connection means and accessory attachment means providing a pivotal connection therebetween allowing said spaced arms to pivot in a vertical plane for exercising the limbs of a person supported on said bench pad.

9. Multi-purpose convertible body exercising apparatus for the type including a longitudinal exercise bench having a body supporting bench pad, and a ground engaging bench frame supporting said bench pad generally above the ground which includes first and second spaced opposed frame ends; said apparatus comprising:

(a) exercise accessory attachment means carried by said exercise bench facilitating the rapid exchange of a variety of accessory exercise apparatus;

(b) said accessory attachment means including first spaced tubular attachment means carried adjacent said first frame end;

(c) accessory exercise apparatus adapted for interchangeable connection to said exercise bench and bench frame by means of said accessory attachment means; and (d) said accessory exercise apparatus including:

a transverse bar extending laterally from said bench frame, a pair of laterally spaced pivots carried by said transverse bar, a pair of corresponding spaced tubular connectors carried by said transverse bar connecting with said first tubular attachment means, a rotatable crank arm carried by each said pivot engageable by a portion of said body, arcuate member connected to said crank arm for rotation therewith, weight support means adapted for supporting a variety of exercise weights, and a flexible cable connected at one end to said arcuate member following said arcuate member and depending downwardly therefrom in a free end, said weight support means being affixed to said free end of said cable so that rotation of said crank arms causes said weights to be raised and lowered.

* * * * *